US005375771A

United States Patent [19]

Jameel et al.

[11] Patent Number: 5,375,771

[45] Date of Patent: Dec. 27, 1994

[54] ADVANCED SOOTBLOWER NOZZLE DESIGN

[76] Inventors: Mohomed I. Jameel, 28 Painswick Crescent, North York, Ontario, Canada, M2J 3M6; Donald E. Cormack, 14 Colonial Avenue, Scarborough, Ontario, Canada, M1M 2C2; Hoc N. Tran, 619 Melita Crescent, Toronto, Ontario, Canada, M6G 3Z2

[21] Appl. No.: 15,902

[22] Filed: Feb. 10, 1993

[51] Int. Cl.[5] ..... F22B 37/52

[52] U.S. Cl. ..... 239/567; 239/590; 239/DIG. 13

[58] Field of Search ..... 239/DIG. 13, DIG. 21, 239/590, 499, 567

[56] References Cited

U.S. PATENT DOCUMENTS

| | | | |
|---|---|---|---|
| 1,242,359 | 10/1917 | McKenna | 239/590 |
| 3,528,704 | 9/1970 | Johnson | 239/496 |
| 4,014,961 | 3/1977 | Popov | 239/432 |
| 4,261,516 | 4/1981 | Tillman | 239/DIG. 21 |
| 4,565,327 | 1/1986 | Rebula et al. | 239/DIG. 13 |
| 5,050,805 | 9/1991 | Lloyd et al. | 239/DIG. 21 |

*Primary Examiner*—Andres Kashnikow
*Assistant Examiner*—Kevin P. Weldon
*Attorney, Agent, or Firm*—Sim & McBurney

[57] ABSTRACT

A nozzle suitable for use with a device for removal of deposits from contaminated surfaces, such as a sootblower in a heat recovery boiler, is designed to avoid normal shock wave formation, and hence energy dissipation, by achieving a condition whereby, the emergent steam pressure ($p_e$) is related to the ambient pressure ($p_\infty$) by the relationship $p_e/p_{28}$ <about 2, preferably about 1. A compact design achieving this result and able to function over a wide range of flow rates comprises a cylindrical body with a downstream convergent outlet and a rounded-head conical insert located axially in the body with its maximum dimension generally coinciding with the commencement of convergence of the outlet and extending through the outlet.

3 Claims, 2 Drawing Sheets

Schematic of current sootblower nozzle and lance arrangement.

Schematic of current sootblower nozzle and lance arrangement.

Schematic Diagram of the Cross-Section of the New Nozzle

EXPLODED VIEW OF THE INSERT FROM FIG.2.

ADVANCED SOOTBLOWER NOZZLE DESIGN

FIELD OF INVENTION

The present invention relates to the removal of deposits from contaminated surfaces by the use of gas jets, particularly sootblowers employed in heat recovery boilers, and, in particular, to a novel nozzle design for use in connection therewith.

BACKGROUND TO THE INVENTION

In operations in which materials are combusted and heat recovered from the flue gas stream from such combustion, heat-exchange surfaces, usually in the form of banks of tubes, are provided in the flow path of the flue gas. The heat exchange surfaces remove heat from the flue gas stream to a cooler fluid medium flowing through the tubes.

Such operations include combustion furnaces of varying types, including coal-fired boilers, oil-fired boilers and pulp mill recovery furnaces, and generally result in the presence of particulates in the flue gas stream. Some of such particles deposit on and adhere to the exposed tube surfaces. These deposits build up on the tube surfaces and decrease the efficiency of heat transfer from the flue gas stream to the heat-exchanger tubes.

From time-to-time, these deposits are removed by jets of high pressure steam or other suitable gas from a so-called sootblower. A sootblower generally consists of an elongate support rod or lance which reciprocates between the bank of tubes and has a spray head having two opposing convergent-divergent nozzles from which high speed steam jets emanate and are aimed at the heat transfer tubes.

In studying the operation of existing sootblower nozzles, we found that sonic conditions exist at the throat of the nozzle with supersonic flow at the exit and that, a normal shock wave (i.e. a shock wave normal to the direction of gas flow) forms a short distance from the nozzle exit. This shock wave causes a considerable reduction in the stagnation pressure of the steam jet. As a result, there is a substantial reduction of available energy for removal of the deposits on the tube bank.

SUMMARY OF INVENTION

The present invention provides a new nozzle design which does not result in a normal shock wave but rather enables the full force of the steam jet to be applied to the tube bank, thereby enabling a more efficient use of steam energy to be achieved. Our analysis has shown that the cause of the normal shock wave is the presence of an underexpanded jet emanating from the nozzles.

The present invention, therefore, provides an improvement in a device for removal of deposits from contaminated surfaces by the application of gas jets comprising a nozzle for the formation of the jets. The improvement comprises constructing and arranging the nozzle such that the pressure of the gas emanating from the nozzle ($P_e$) bears a relation to the ambient pressure ($P_\infty$) such that a shock wave normal to the flow of the gas jets is not formed.

The novel nozzle geometry provided herein enables proper expansion to be achieved in a compact nozzle structure which permits flexibility of operation over a range of values for the mass flow rate and yet avoids normal shock wave formation.

This invention is particularly directed to sootblower operations wherein steam is employed to remove deposits in heat recovery boilers. However, the present invention is broadly directed to a nozzle design for use in any device removing deposits from contaminated surfaces using any form of gas stream.

GENERAL DESCRIPTION OF INVENTION

Figure 1:
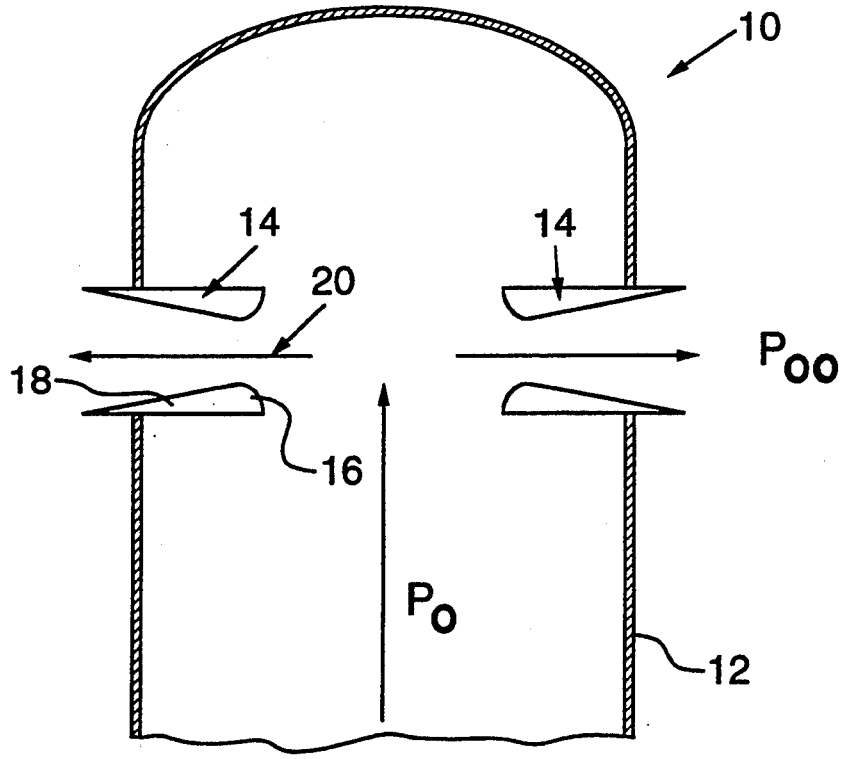
FIG. 1 is a schematic representation of a sootblower lance with a sectional view of conventional convergent-divergent sootblower nozzles.

The hydrodynamic behaviour of pressurized steam flowing through a sootblower nozzle may be considered to resemble that of a gas flowing through a convergent-divergent nozzle, as seen in FIG. 1. If $P_o/P_\infty$ (i.e. the ratio of the stagnation pressure of the gas in the feed pipe to the nozzle to that of the ambient atmosphere beyond the downstream end of the sootblower nozzle)$=[(\gamma+1)/2]^{\gamma/\gamma-1}$, wherein $\gamma$ is the specific heat ratio Cp/Cv of the gas, then the flow in the throat of the nozzle reaches the speed of sound. If $P_o/P_\infty$ is greater than this critical value, the flow speed in the divergent section of the nozzle becomes supersonic.

For larger values of $P_o$, the pressure at the exit plane of the nozzle ($P_e$) can exceed the ambient pressure ($P_\infty$) and the gas has to expand outside the nozzle to come into equilibrium with its surroundings. We have found that, if $P_e/P_\infty >$about 2, there occurs a normal shock wave just downstream of the nozzle, while manipulation of the nozzle design to provide the relationship less than about 2, preferably about 1, avoids formation of the normal shock wave. Increasing the value of $p_o$ means a larger value of $P_e$, which results in a stronger shock wave. The shock wave substantially reduces the stagnation pressure (useful mechanical energy) contained in the steam jet and decreases its effectiveness for cleaning contaminated surfaces.

The problem of the underexpanded gas stream theoretically can be solved by simply extending the downstream portion of the nozzle, so as to properly expand the jet to provide $P_e/P_\infty <$about 2. However, the resulting nozzle simply is too large to fit into the narrow passages through which the sootblower passes. In addition, this design of nozzle limits the range of mass flow rate of the steam for which proper expansion can be achieved by the nozzle.

The present invention provides a compact nozzle design which permits proper expansion of the gas, so that the formation of the normal shock wave is avoided. In addition, the design permits operation within the same nozzle over a wide range of values for the mass flow rate. This mode of design is highly desirable since expansion of the gas in the divergent section of existing nozzles is governed solely by the diverging walls of the nozzle. The effectiveness of such prior art nozzles is substantially decreased when operated away from design conditions.

Although numerous nozzle designs are possible to achieve the result provided herein, one such nozzle constructed in accordance with the invention comprises a cylindrical body member having an upstream inlet and a convergent downstream outlet or lip and a conical insert axially located adjacent the downstream end of such body member and extending therefrom and having a maximum transverse dimension located within the body member, usually adjacent to or upstream of the commencement of convergence of said outlet. The insert may have a streamlined head to facilitate smooth flow of gas in the nozzle.

By employing such design, the nozzle throat is defined by the location of minimum flow area at the lip of the convergent section and the exhausting steam flow is directed towards the surface of the insert by the lip. After the gas has passed the downstream end of the convergent outlet, the gas expands to atmospheric pressure while following the contour of the surface of the conical insert.

A nozzle having this construction may operate under a variety of flow rates. The nozzle is of compact design and hence can readily replace existing sootblower nozzles without introducing space constraints. However, where the provision of the axially-extending conical insert may pose a problem in this regard, the insert may be truncated, with some small loss of efficiency which increases with the degree of truncation.

Alternatively, the head of the lance in which the sootblower nozzles are mounted may be designed to have a reduced diameter in comparison to the remainder of the lance.

The ideal relationship of $P_e$ to $P_\infty$ is a ratio of 1. At values greater than 1, i.e. $P_e > P_\infty$, the gas jet is underexpanded and has to undergo a further expansion process outside the nozzle walls, to decrease the jet pressure to that of the ambient. In the design of nozzle just described, any such expansion commences at the tip of the convergent downstream outlet or lip and is directed by both the ambient pressure boundary on one side and the solid boundary of the insert on the other, so as to produce a properly expanded jet ($P_e = P_\infty$), which flows parallel to the jet axis. The expansion of the gas at the lip is achieved through a simple isentropic Prandtl-Meyer expansion fan. The resultant flow direction, $\omega$, that occurs as the gas expands to a new Mach number M, for a given Prandtl-Meyer fan is:

$$\omega = \sqrt{\frac{\gamma+1}{\gamma-1}} \arctan \sqrt{\frac{\gamma-1}{\gamma+1}(M^2-1)} - \arctan \sqrt{M^2-1} \quad (1)$$

where the specific heat ratio of the gas is $\gamma = C_p/C_v$.

A gas starting at a stagnation pressure $P_o$ expands isentropically according to the equation:

$$\frac{p_0}{p} = \left[1 + \frac{\gamma-1}{2} M^2\right]^{\frac{\gamma}{\gamma-1}} \quad (2)$$

Using equation (2), for a desired value of stagnation pressure of the steam or other gas $P_o$, it is possible to determine the corresponding value of the nozzle exit plane Mach number $M_e$ such that $P_e/P_\infty = 1$. Using equation (1), it is possible to determine the inclination of the convergent downstream outlet $\omega_e$.

Figure 3:
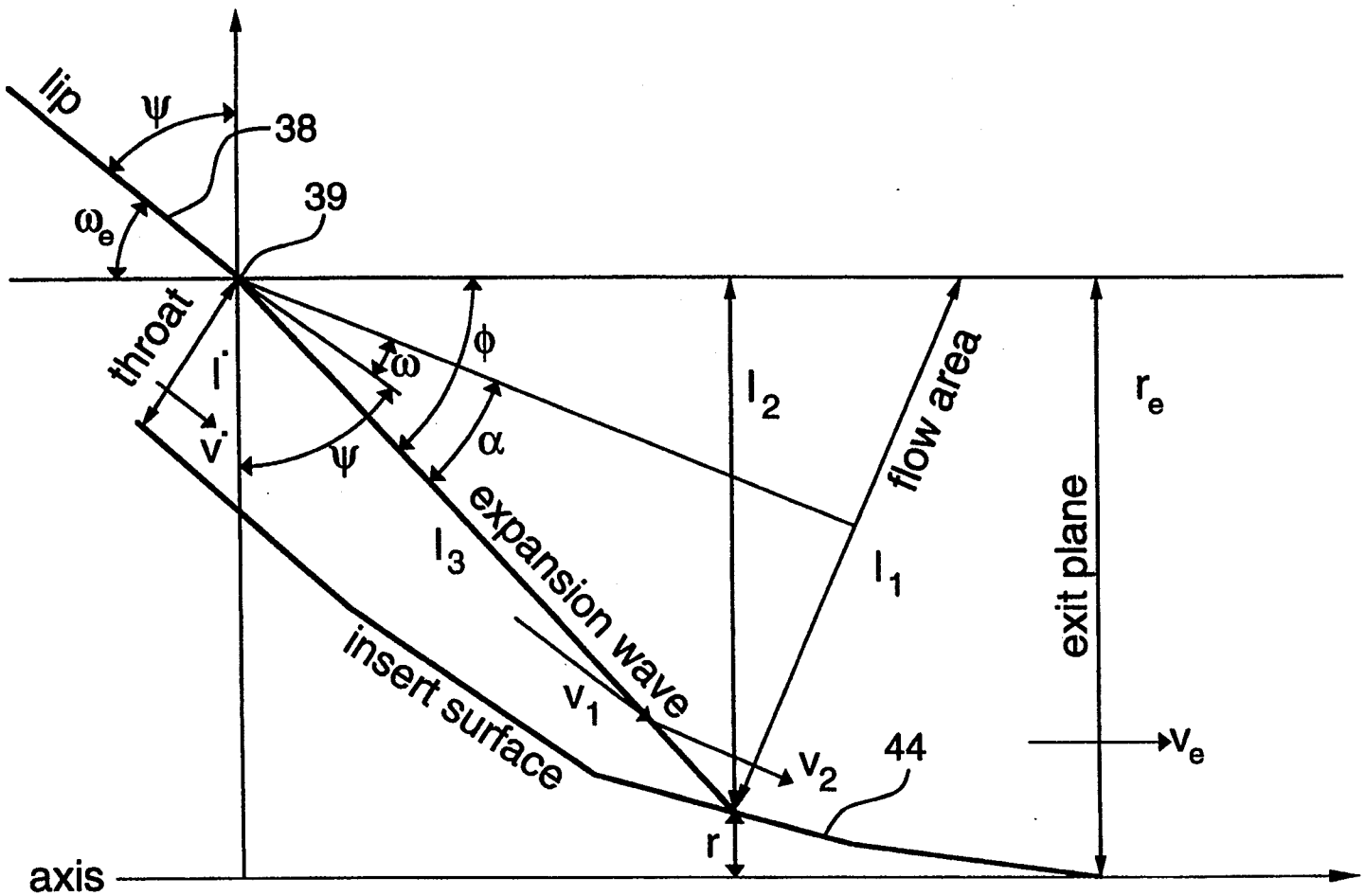
FIG. 3 is a close-up detail of dotted outline area of the nozzle of FIG. 2.

In FIG. 3, there is shown a detail of the relationship of the downstream tip of the convergent outlet or lip and the outer surface of the insert member. The local radius of the insert is r while that of the jet exit is $r_e$. As seen in FIG. 3, the outer surface of the insert member is illustrated as smoothly curved, which is the theoretically-correct relationship, in accordance with the analysis made below. As a first approximation, a flat surface may be employed. Having regard to the relatively compact dimension of the nozzle provided herein, the utilization of a flat surface leads to little loss in efficiency. $l_3$ is the length of the expansion (Mach) wave that originates at the downstream lip of the convergent outlet. The fluid vector v1 crossing this wave is deflected and results in a new vector v2. The flow area normal to the vector is of length $l_1$. If $\phi$ is the inclination of wave with the nozzle axis, $\alpha$ is the angle of the Mach wave with the vector v2 and $\psi$ the inclination of the convergent member or lip with the vertical.

$$\psi = 90 - \omega_e \quad (3)$$

By simple geometric and trigometric manipulations, it is possible to determine $l_3$ as a function of the flow area $A = \pi(r + r_e)l_3$. The isentropic relation between the flow area A, at any location along the nozzle axis, the throat area A* and the local Mach number M is given by the expression:

$$\frac{A}{A^*} = \frac{1}{M}\left[\frac{2}{\gamma+1}\left(1 + \frac{\gamma-1}{2} M^2\right)\right]^{\frac{\gamma+1}{2(\gamma-1)}} \quad (4)$$

By commencing at the downstream tip of the insert where $M_e$ is known from equation (2) and the area ratio $A_e(=\frac{1}{4}\pi r_e^2)/A^*$, is obtained from equation (4), it is possible to move progressively upstream towards the nozzle throat using the relation $A/A_e = (A/A^*)(A^*/A_e)$, so as to determine the radial length $l_3$ and the angle $\phi$ that the expansion wave makes with the axis. Knowledge of these two parameters then enables one to trace the profile of the insert through a curve in polar coordinates that uses the tip of the lip at the downstream outlet of the convergent nozzle portion at its origin.

A nozzle constructed in accordance with one embodiment of the invention can be dimensioned to correspond to the throat diameter of conventional sootblower nozzles, namely about $\frac{7}{8}$ to about $1\frac{1}{4}$ inches, and can operate over a wide range of values of mass flow rates, for example, ranging from about $10^4$ lbm/hr to about $2 \times 10^4$ lbm/hr, without the formation of a normal shock wave downstream of the nozzle. By avoiding the formation of such shock wave, the nozzle design provided herein permits efficient use of steam energy in cleaning contaminated heat-exchanger surfaces, in contrast to the prior art.

To achieve the above mass flow rates in a one-inch throat diameter nozzle, applying the principles described above, the conical insert element may be dimensioned to have a maximum diameter at its upstream end corresponding to about 2.4 to about 3.8 inches while the total diameter of the nozzle, is about 2.7 to about 3.5 inches.

The conical insert member may have a length of about 3.2 to about 5 inches, thereby defining a conical angle of about 41°. The convergent downstream end or lip of the nozzle body may converge at an angle corresponding to about 46° to about 56° with the nozzle axis to the tip 39 spaced at a distance of about 1.4 to about 1.8 inches from the nozzle axis.

The convergent downstream end of the nozzle may extend in the upstream direction, approximately for the distance between the tip of the lip and the insert.

DESCRIPTION OF PREFERRED EMBODIMENT

As seen in FIG. 1, a sootblower 10 comprises an elongate body or lance 12 through which steam passes to opposed outlet nozzles 14, which spray jets of steam towards the surfaces to be cleaned.

The nozzles 14 include a first convergent portion 16 and a second divergent portion 18 defining a throat 20 therebetween, so that the steam first is accelerated and then expanded. The shortcomings of such design under normal sootblower operations have been described above.

Figure 2:
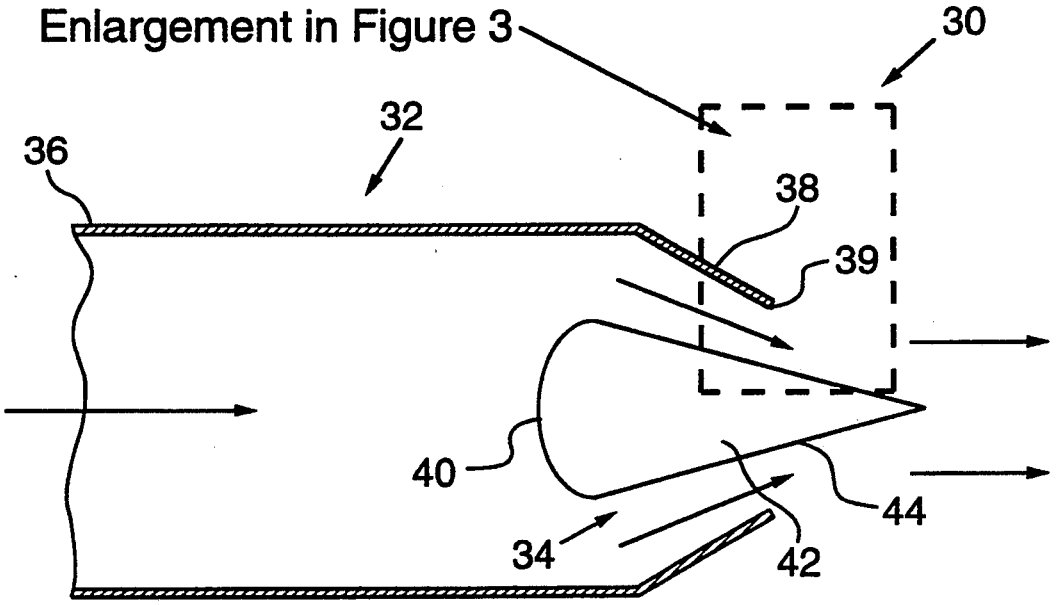
FIG. 2 is a sectional view of a novel sootblower nozzle provided in accordance with one embodiment of the invention.

Turning now to FIG. 2, there is illustrated therein a novel design of nozzle 30 to replace the conventional convergent-divergent nozzle 14 in sootblower 10. The nozzle 30 comprises a body member 32 and an insert or plug member 34. The body member 32 comprises an upstream cylindrical portion 36 and a downstream convergent portion or lip 38 which terminates at a tip 39.

The insert member 34 comprises a rounded upstream head portion 40 to provide a streamlined gas flow and loss of gas pressure. While a rounded head portion 40 is illustrated, other geometrical shapes may be utilized to provide the streamlined flow, for example, conical. The head portion 40 has a maximum dimension at a location corresponding to approximately the commencement of convergence of the body member 32. The insert member 34 also includes a downstream conical portion 42 which extends through the downstream end of the body member 32 and has an outer surface 44. The relationship of the lip 38 and its tip 39 to the outer surface 44 of the conical insert 34 and the manner in which such relationship provides for proper expansion of the gas stream have been described above with respect to FIG. 3.

The nozzle 30 enables the steam rapidly to achieve ambient pressure without permitting a normal shock wave formation condition to be achieved, thereby overcoming the problem of current nozzle designs.

SUMMARY OF DISCLOSURE

In summary of this disclosure, sootblower operation is improved and steam energy usage is enhanced by employing a novel nozzle design which ensures a condition of $P_e/P_\infty <$ about 2 to be achieved, particularly in a compact design. Modifications are possible within the scope of this invention.

What we claim is:

1. In a device for removal of deposits from contaminated surface by the application of gas jets to said surfaces, the improvement which comprises:

an elongate hollow lance for feed of gas to a pair of nozzles mounted on opposite diametrical sides of the downstream end of said lance in fluid communication with the hollow interior of the lance for discharge of a gas jet from each nozzle to the ambient atmosphere surrounding said downstream end of said lance, each said nozzle comprising:

a body member and an insert member, said body member comprising an upstream cylindrical portion and a downstream convergent portion, said insert member having a conical body portion extending from a maximum dimension located within said body member through the downstream end of said body member to define a throat between a tip of said convergent portion and an adjacent outer surface of said insert member, each said nozzle being constructed and arranged such that the pressure of the gas emanating from the nozzle ($p_e$) bears a relation to the ambient pressure ($p_\infty$) surrounding the nozzle such that a shock wave normal to the flow of the gas jets is not formed.

2. The device of claim 1 wherein said downstream end of said lance has a reduced diameter in comparison to the remainder of the length thereof.

3. In a device for removal of deposits from contaminated surfaces by the application of gas jets to said surfaces comprising a nozzle for formation of said gas jets, the improvement wherein said nozzle comprises:

a body member and an insert member, said body member comprising an upstream cylindrical portion and a downstream convergent portion, said insert member having a conical body portion extending from a maximum dimension located within said body member through the downstream end of said body member to define a throat dimensioned from about $\frac{7}{8}$ to about $1\frac{1}{4}$ inches between a tip of said convergent portion and an adjacent outer surface of said insert member, the members of said nozzle and their interrelationship being dimensioned to correspond for said throat dimension to those for a throat dimension of one inch, namely said insert member has a maximum diameter at its upstream end of about 2.4 to about 3.8 inches and a length of about 3.2 to about 5 inches, said downstream convergent portion defines an angle of about 46° to about 56° with a longitudinal axis of the nozzle and converges to said tip spaced about 1.4 to about 1.8 inches from the longitudinal axis of the nozzles, whereby said nozzle is constructed and arranged such that the pressure of the gas emanating from the nozzle ($p_e$) bears a relation to the ambient pressure ($P_\infty$) surrounding the nozzle such that a shock wave normal to the flow of the gas jets is not formed.

* * * * *